United States Patent [19]

Miller

[11] 4,382,716

[45] May 10, 1983

[54] BLOWOUT RECOVERY SYSTEM

[76] Inventor: Troy Miller, 3463 Castleton Way North, Lexington, Ky. 40502

[21] Appl. No.: 239,243

[22] Filed: Mar. 2, 1981

[51] Int. Cl.[3] ..... E02B 15/04

[52] U.S. Cl. ..... 405/60; 405/52

[58] Field of Search ..... 405/60, 53, 209, 195; 210/922, 923; 166/357, 359

[56] References Cited

U.S. PATENT DOCUMENTS

| | | | |
|---|---|---|---|
| 3,643,741 | 2/1972 | Miranda | 405/60 X |
| 3,653,215 | 4/1972 | Crucet | 405/60 |
| 3,667,605 | 6/1972 | Zielinski | 405/60 X |

FOREIGN PATENT DOCUMENTS

| | | | |
|---|---|---|---|
| 1544710 | 4/1979 | United Kingdom | 405/60 |

*Primary Examiner*—Dennis L. Taylor

*Attorney, Agent, or Firm*—Nathaniel A. Humphries

[57] ABSTRACT

A blowout recovery vehicle for recovering the discharge from underwater wells comprises a large inverted entrapment shell positionable over a well and having overly extending tubes connected by hose means to surface separation and storage equipment. Floatation tanks are connected to the surface by air lines which are actuated to adjust the buoyancy of the device to raise or lower it so that it can be lowered over a well to trap the discharge from the well. In use, the assembled device can be towed by a tug into position or can be assembled in the water at the site and lowered over the well without the necessity of the tug coming into the effluent discharge area above the well. Alternatively, an anchor can be placed in the seabed directly upstream of the well at some distance from the well. The device can be tied to the anchor by a tow line of exact length equal to the distance between the well and the anchor and positioned either to the right or left of the well so that the force of the current will cause the device to swing about the anchor so that guidance from a surface vessel can position the device over the well.

11 Claims, 7 Drawing Figures

BLOWOUT RECOVERY SYSTEM

BACKGROUND OF THE INVENTION

The present invention is in the field of environmental protection equipment and is more specifically directed to a new and unique device for entrapping the effluent being discharged from a damaged or inoperative underwater oilwell to permit the recovery of the effluent for subsequent processing so as to minimize environmental pollution and the attendant damage resultant therefrom.

Underwater oilwells have become more and more widely employed throughout the world in recent years and it is an unfortunate fact that malfunctions or damage to such wells can result in the discharge of crude oil into the body of water in which such wells are located. The resultant damage from such discharge of crude oil can amount to many millions of dollars as is well known. These facts have resulted in a variety of approaches for preventing such undesirable discharge of crude oil. For example, all underwater wells are provided with expensive and sophisticated blowout preventer equipment. However, such equipment does not always function properly as evidenced by the 1979 blowout of Mexico's Pemex Ixtoc 1 well in the Gulf of Mexico.

After a blowout occurs, it is imperative that corrective measures be taken as soon as possible in an effort to terminate the discharge of effluent from the well. However, such procedures sometimes requires extremely time-consuming procedures lasting several months such as the drilling of offset wells to intersect the blowout well with the damage from the blowout continuing unabated until shut-off is finally effected. There has consequently been a great need for apparatus for reducing the damage and loss of crude oil during the time that a permanent cutoff is being effected. For example, a large inverted funnel having a forty foot diameter was lowered by cable over the Ixtoc 1 well in an effort to entrap the discharge from the well with the funnel being suspended by cables from a supporting vessel. A hose from the funnel was connected to separation equipment on the surface with it being the intention to discharge the oil into tankers. Unfortunately, this inverted funnel system, which weighed approximately 310 tons exerted a great resistance to movement by virtue of its substantial mass and its geometry which creates substantial water resistance so that vertical movement of the support vessel is resisted by the inverted funnel to create extremely high forces on the supporting cable structure. Consequently, wave action on the supporting vessel rsulted in undue stress and mechanical failure of the supporting structure and the use of the device had to be terminated and abandoned.

Another problem with oil entrapment devices which are supported by cables is that the supporting vessel must necessarily be in the area above the blowout which may well be on fire or which at least presents a substantial hazard of fire. Consequently, it has been recognized that such cable suspended entrapment devices do not provide a satisfactory solution to the problem of recovering the discharged effluent from an underwater blowout. A description of the entrapment equipment employed in the Ixtoc 1 well blowout is found in the May 1980 issue of "Popular Mechanics".

Therefore, it is the primary object of this invention to provide a new and improved effluent entrapment means for underwater oilwell blowouts.

Obtainment of the object of the invention is achieved by the preferred embodiment through the employment of a submergeable vehicle which can be trailed behind and towed by a surface vessel and which has buoyancy adjustment means for effecting raising or lowering of the vehicle to vertically position it with respect to an underwater blowout. More specifically, the vehicle includes a hollow effluent entrapment shell member of generally conical configuration which is open at the bottom and is of sufficient dimensions as to be positioned in a cap-like manner over an underwater well. The effluent entrapment shell is connected to a vertically extending main spinal tube which communicates on its lower end with the upper portion of the interior of the shell and extends vertically thereabove with a plurality of radial outflow tubes being connected to the spinal tube at a substantial distance above the effluent entrapment shell. Additionally, canted brace tubes are also connected to the main spinal tube on their lower ends at a location adjacent the effluent entrapment shell and on their upper ends to the radial outflow tube members. The radial outflow tubes and the spinal tube are connected by hose means to floating separation equipment provided on a barge or the like on the surface of the body of water in which the well is located with a plurality of buoyancy tank members being coaxially mounted on and around the spinal tube, the radial outflow tubes and the canted brace tubes. Air lines extend to the surface for providing compressed air to the buoyancy tanks so as to permit the expelling of the water in the tanks through outlet openings adjacent the bottom of the tanks so as to provide for a desired buoyancy for the entire vehicle.

In use, the preferred embodimet is towed into position above the blowout and the air in the buoyancy tanks is permitted to escape so as to cause the entire device to settle slowly downwardly over the blowout to entrap the effluent therefrom. The effluent is consequently discharged outwardly through the hose means to the separator means on the surface with it being possible to trap substantially all of the effluent so as to minimize environmental and economic damage.

A better understanding of the construction and operation of the preferred embodiment will be achieved when the following detailed description is considered in conjunction with the appended drawings in which like reference numerals are used for the same parts as viewed in the different figures.

DESCRIPTION OF THE PREFERRED EMBODIMENT

Figure 1:
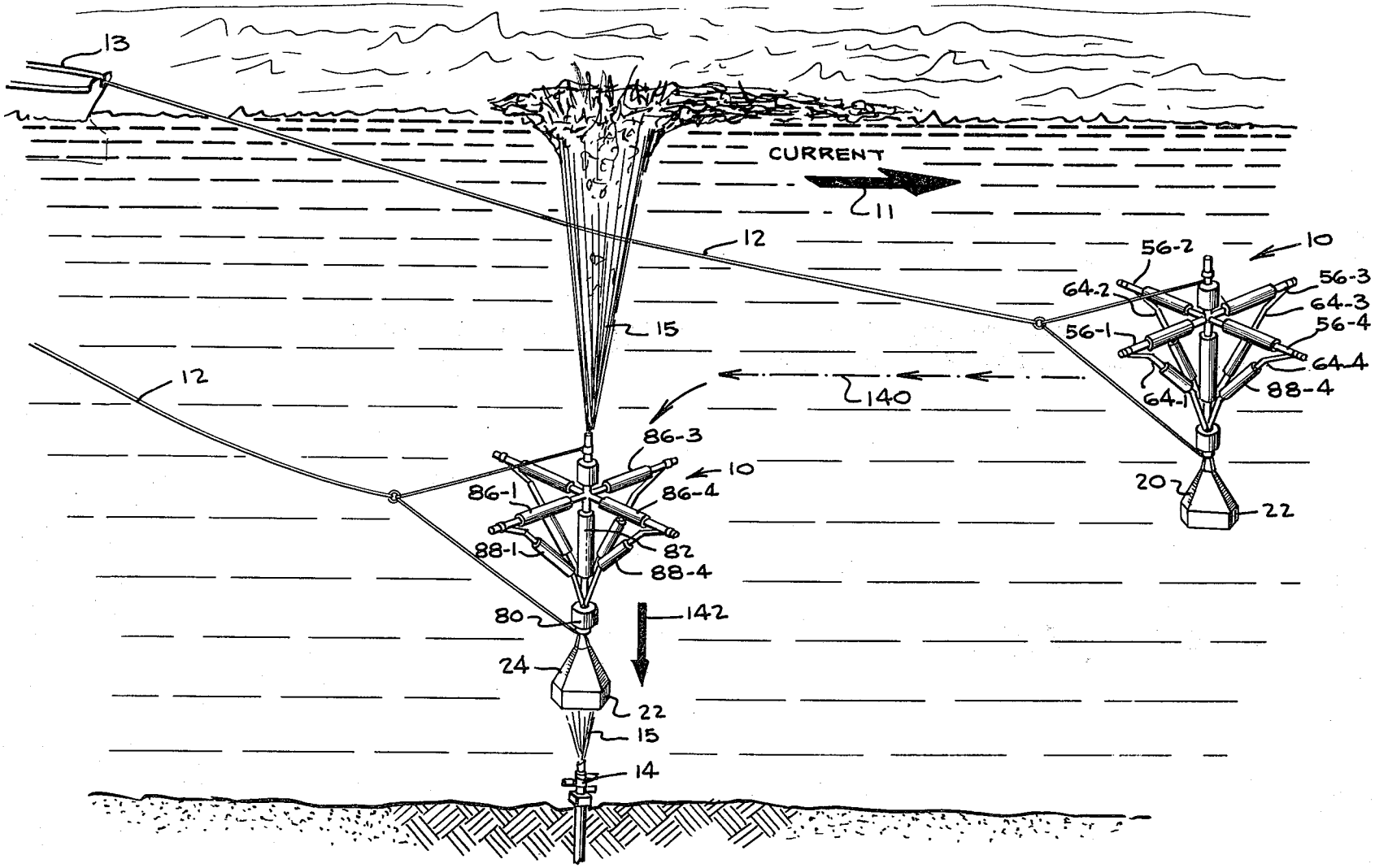
FIG. 1 is a perspective view illustrating the structure and initial steps in a first method of operation of the preferred embodiment.

The preferred embodiment of the invention consists of a towable vehicle 10 which can be moved in a body of water by a towline 12 from a surface support vessel such as a tug 13 into position over a submerged wellhead 14 for receiving the effluent 15 therefrom which is directed to a floating separation tank 16 in which water and petroleum components are separated with the petroleum components being directed into a storage tank 18 for subsequent removal to a tender and the gaseous components being vented to atmosphere through vent 17.

Figure 4:
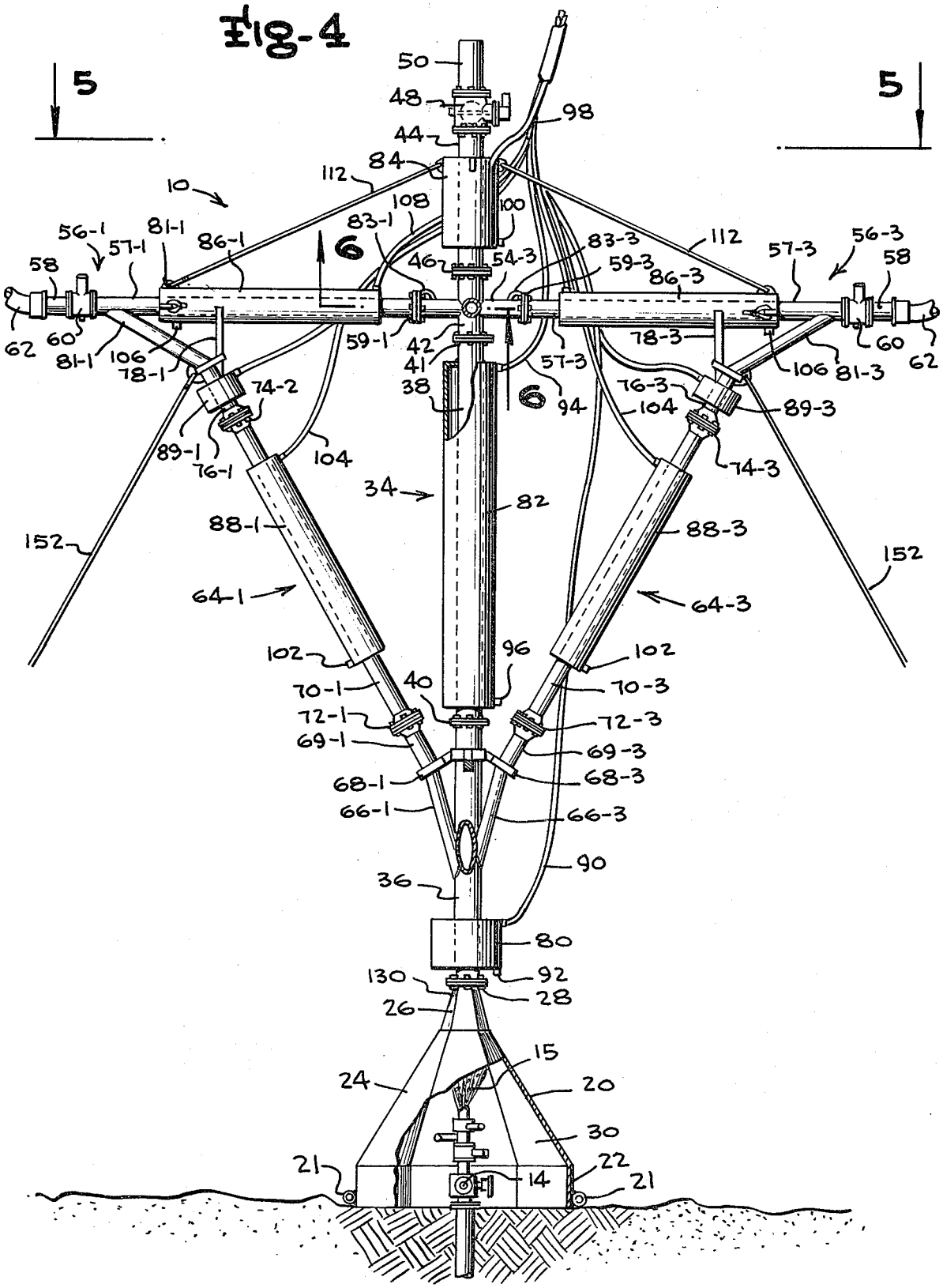
FIG. 4 is an elevation view of the preferred embodiment in position over an underwater blowout and with portions removed from clarity of illustration of internal components.
Figure 5:
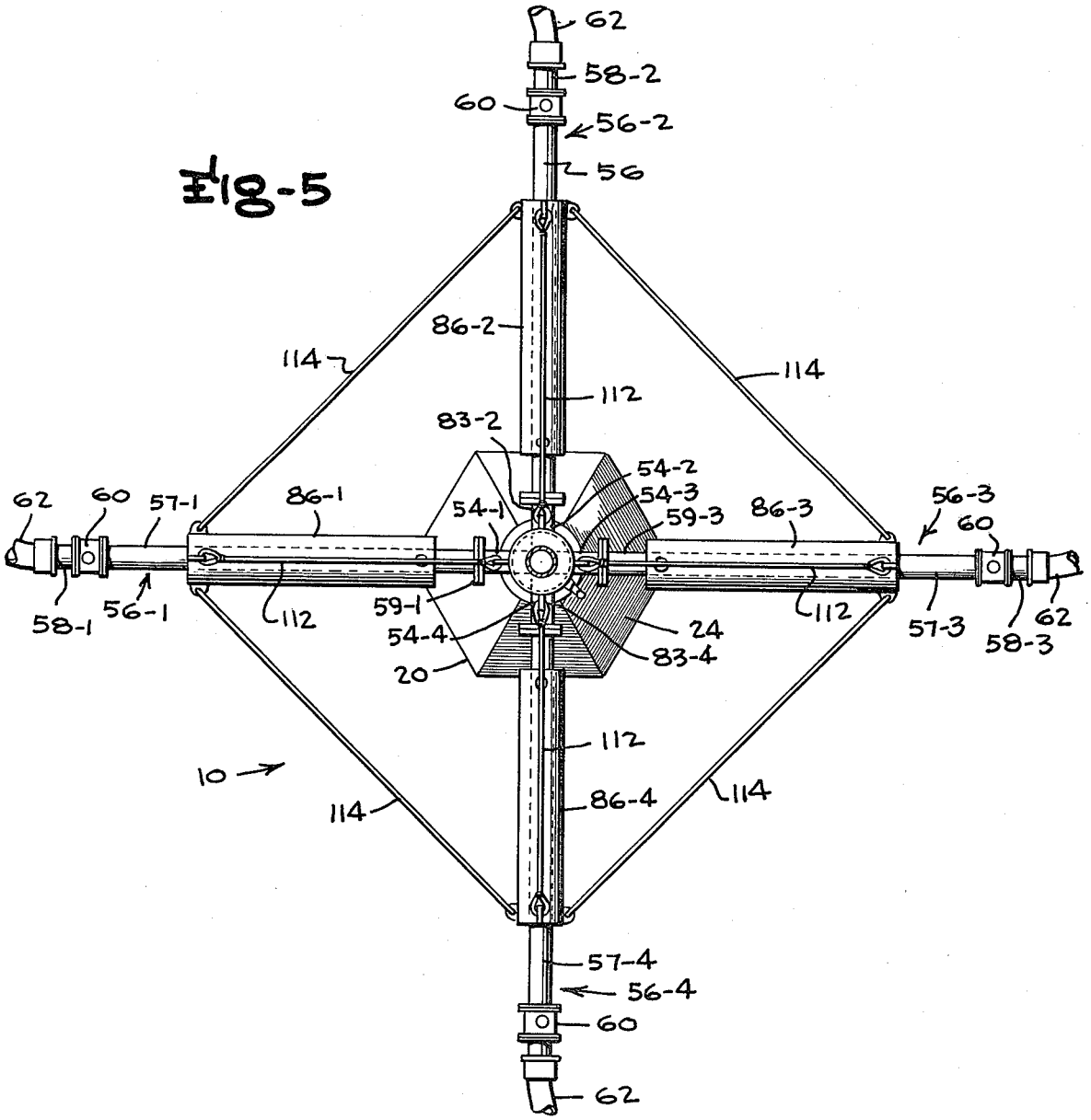
FIG. 5 is a sectional view taken along lines 5—5 of FIG. 4.
Figure 6:
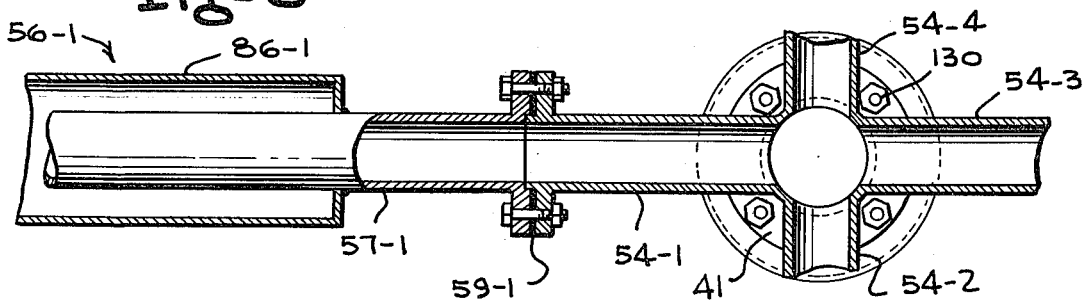
FIG. 6 is a sectional view taken along lines 6—6 of FIG. 4.

Turning now to the details of construction of the towable vehicle 10, attention is primarily invited to FIGS. 4, 5 and 6 which illustrate the components thereof. More specifically, towable vehicle 10 comprises a downwardly facing effluent entrapment shell 20 of thick-walled steel construction of generally conical configuration which is open at the bottom as best shown in FIG. 4. It will be observed that the effluent entrapment shell 20 is of generally hexagonal configuration as viewed from above and includes a skirt portion 22 formed of plates positioned in vertical planes, an intermediate portion 24 formed of inwardly canted plates and an upper top portion 26 having a flange 28 at its upper end. The effluent entrapment shell 20 consequently provides an internal hollow chamber 30 which can be fitted over a wellhead 14 for receiving the effluent discharge 15 of a blowout from the wellhead as shown in FIG. 4.

Tubular outflow means including a vertically extending main spinal tube 34 is connected to the effluent entrapment shell 20 for removing the effluent in a manner to be discussed. The main spinal tube 34 includes a lower tube section 36 connected at its lower end to the flange 28, an intermediate tube section 38 connected at its lower end by a flange junction 40 to the upper end of the lower tube section 36, a juncture section 42 and an upper section 44. Upper section 44 is connected by a flange junction 46 to the upper juncture 42 with a valve 48 and exhaust tube 50 being attached to the upper end of upper section 44 as shown in FIG. 4.

Four horizontal radial tubes or arms 56-1, 56-2, 56-3 and 56-4 (FIG. 2) are connected to the juncture section 42 and extend outwardly therefrom as best shown in FIGS. 5 and 6 with the radial tubes including inner tube sections 54-1, 54-2, 54-3 and 54-4 respectively, intermediate tube sections 57-1, 57-2, 57-3 and 57-4 respectively and outer tube sections 58-1, 58-2, 58-3 and 58-4 respectively with the inner tube section 54-1 etc. and the intermediate tube sections 57-1 etc. being connected by flange junctions 59-1, 59-2, 59-3 and 59-4 respectively. Valves 60-1 etc. are positioned between the outer end of intermediate tube sections 57-1 etc. and the inner end of outer tube sections 58-1 etc. Flexible hose conduits 62-1 etc. are connected to the outer ends of each of the outer tube sections 58-1 etc. with the opposite ends of the hose members being connected to the floating separation tank 16.

Additionally, four canted brace tubes 64-1, 64-2, 64-3 and 64-4 are mounted with their lower ends connected to the lower tube section 36 in an area fairly close to the effluent entrapment shell 20 and with their upper ends respectively connected to the intermediate tube sections 57-1, 57-2, 57-3 and 57-4 of the horizontal radial tube members. More specifically, each of the canted brace tubes 64-1 etc. includes lower tube sections 66-1 etc. welded at their lower ends to the lower tube section 36 of the main spinal tube 34 and which are welded at their upper ends to attachment brackets 68-1 etc. Short connector tube sections 69-1 etc. extend outwardly from brackets 68-1 etc. and are connected by flange junctions 72-1 etc. to intermediate canted tube sections 70-1 etc. The upper ends of intermediate canted tube sections 70-1 etc. are connected by flange junctions 74-1 etc. to second short connector tube sections 76-1 etc. each having its upper end positioned in holding brackets 78-1 etc. with upper canted tube sections 81-1 etc. being connected to connector tube sections 76-1 etc. lower end and to intermediate tube sections 57-1 etc. on its upper end.

Hollow floatation tank means are provided for adjusting the buoyancy of vehicle 10 with the tank means mounted on spinal tube 34 including a lower tank 80, a middle tank 82 and an upper tank 84. It will be observed that each of the tanks 80, 82 and 84 is of cylindrical configuration and that tank 80 is coaxially mounted on lower tube section 36 with tanks 82 and 84 being similarly mounted on tube sections 38 and 44 respectively. Similarly, cylindrical tanks 86-1, 86-2, 86-3 and 86-4 are respectively coaxially mounted over and on the intermediate tube sections 57-1, 57-2, 57-3 and 57-4 of the horizontal radial tube members 56-1 etc. Cylindrical hollow floatation tanks 88-1, 88-2, 88-3 and 88-4 are similarly respectively mounted on the intermediate canted tube sections 70-1, 70-2, 70-3 and 70-4 and floatation tanks 89-1, 89-2, 89-3 and 89-4 are respectively mounted on connector tube sections 76-1, 76-2, 76-3 and 76-4.

Rings 81-1, 81-2, 81-3 and 81-4 are welded to the outer ends of tanks 86-1, 86-2, 86-3 and 86-4. Similarly, rings 83-1, 83-2, 83-3 and 83-4 are welded to the outer ends respectively of inner tube sections 54-1, 54-2, 54-3 and 54-4.

It should be observed that an air line 90 is connected to the upper end of the lower tank 80 and extends to a surface support and control station such as tug 13 which carries compressor and control equipment for permitting the selective and controlled supply of compressed air to the interior of lower tank 80. A discharge or exhaust nipple 92 is provided in the lower portion of the lower tank 80 so that the introduction of compressed air through line 90 into the upper interior tank portion forces water outwardly through the exhaust nipple 92 in an obvious manner. An air line 94 is similarly connected to middle tank 82 which has an exhaust nipple 96 and tank 84 is similarly connected to an air line 98 extending to the surface support vessel 13 with an exhaust nipple 100 being provided on the lower end of the tank so that the introduction of compressed air from air line 98 serves to force water from within tank 84 outwardly through exhaust nipple 100. The floatation tanks 88-1 etc. similarly have exhaust nipples 102 at their lower ends and are connected to airlines 104 extending upwardly to the support vessel. Exhaust nipples 106 are similarly provided on the floatation tanks 86-1 etc. which are connected to airlines 108 extending to the support vessel. Tanks 89-1 are similarly connected to airlines (not shown) so as to be capable of being filled with air or of being flooded with water.

In operation, the airlines are controlled from the support vessel 13 to introduce a desired amount of air into the floatation tanks to achieve a desired buoyancy effect for moving the vessel 10 either upwardly or downwardly in the body of water in which it is positioned. It is consequently possible for the vehicle 10 to be positioned over a well such as well 14 and then lowered downwardly over the well.

Structural integrity of the vehicle 10 is maintained by the employment of four brace rods 112 extending between the upper tank 84 and the outer ends of floatation tanks 86 with side brace rods 114 similarly being connected between rings 81 on the outer ends of the horizontal floatation tanks 86 as best shown in FIG. 5.

Figure 3:
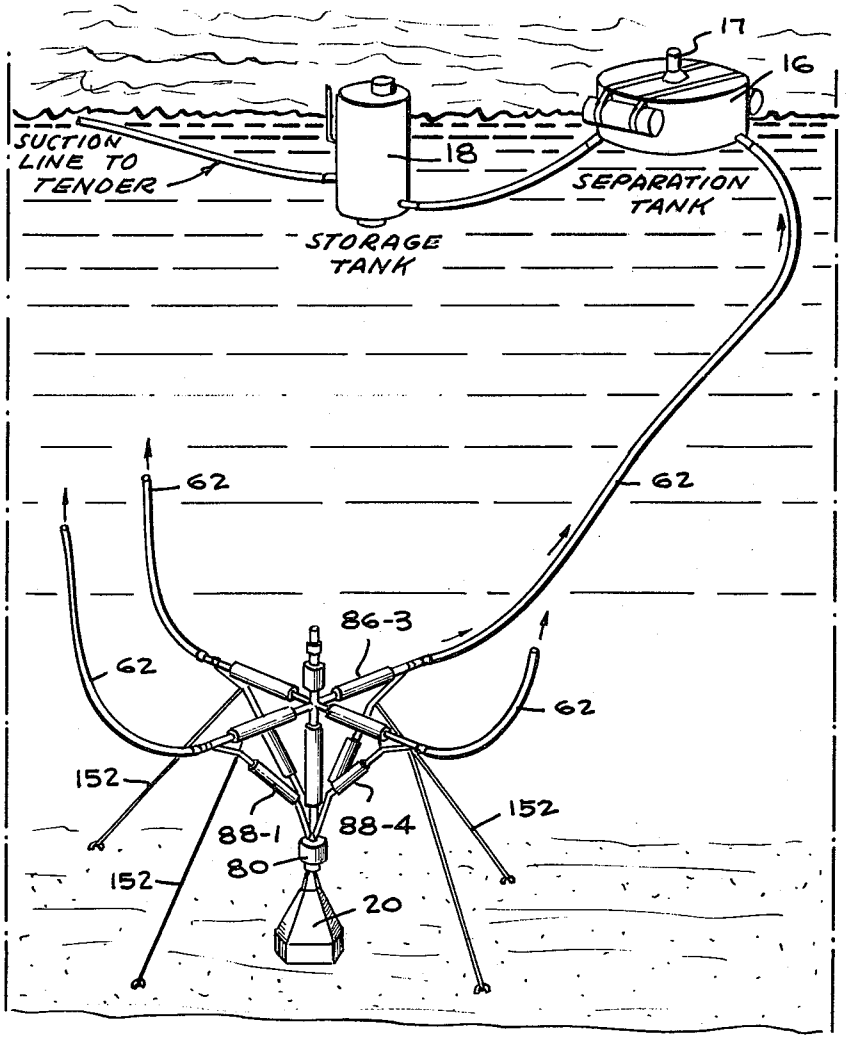
FIG. 3 is a perspective view similar to FIG. 2 but showing all of the components in final position and connected to surface separation equipment.
Figure 2:
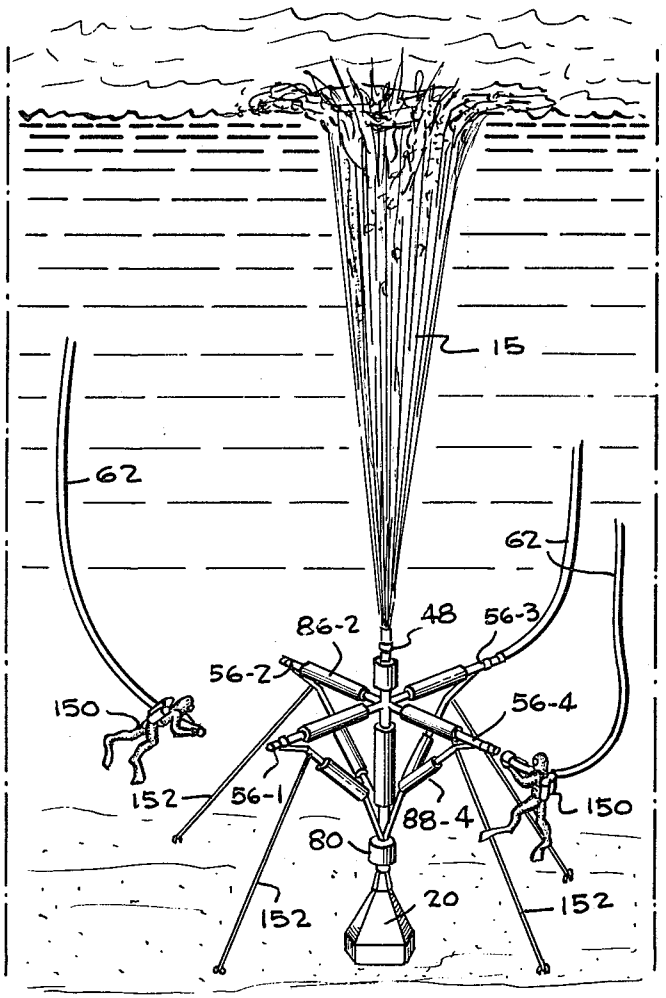
FIG. 2 is a perspective view illustrating the subsequent step of positioning of the preferred embodiment over a blowout.
Figure 7:
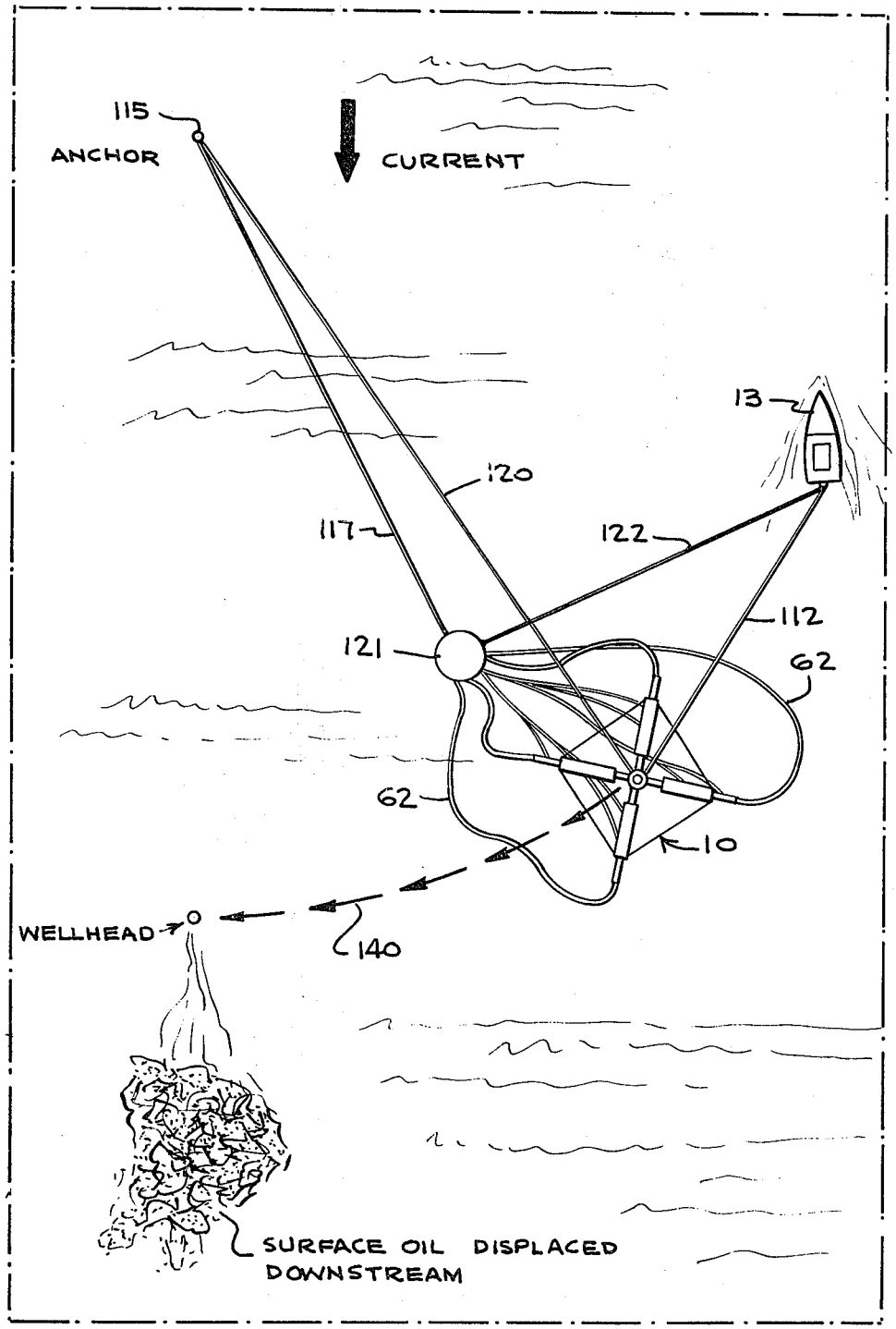
FIG. 7 is a perspective view illustrating a preferred manner of positioning the device over a wellhead.

FIG. 7 illustrates a preferred mode of positioning of the device over a wellhead which is preferred over that of FIGS. 1 through 3 (to be discussed) in that it permits a more rapid, accurate and secure positioning of the device over the wellhead. This result is effected by virtue of the fact that the device need not be assembled until near the site of the wellhead and it is consequently possible to move the unassembled device to the wellhead site on a vessel at a speed greater than the speed at which the assembled device can be towed. These results are possible due both to the unique construction and unique manner of assembly at the site.

More specifically, the lower tank 80 is sized and positioned in such a manner that it will cause shell 20 and section 36 to float horizontally as a unit when thrown overboard. In some instances it may be necessary to provide a floatation tank encircling shell 20 near its larger end to provide balanced buoyancy so that section 36 and shell 20 float horizontally. Similarly, tank 82 is sized and positioned on section 38 in such a manner that section 38 will also float horizontally so as to allow connection 40 to be made between sections 36 and 38 as the first step on the assembly of the device while the sections are floating in a horizontal manner. The junction section 42 is connected to the upper section 44 so that they float as a unit in a horizontal manner due to the fact that tank 84 is sized and positioned to provide horizontal floatation. It is consequently an easy matter for the unit 42, 44 to be connected to the remaining spinal assembly components by connecting upper juncture 42 to section 38 at the flange junction 41. Thus, the entire spinal assembly consisting of shell 24, sections 36, 38, 42, and 44 is joined together as a unit while floating on the surface of the body of water near the wellhead site.

The horizontal radial tubes 56-1, 56-2, 56-3 and 56-4 are also capable of horizontal floatation due to the fact that tanks 86-1 etc. and 89-1 etc. are sized and positioned to provide balance and support for horizontal floatation. Horizontal radial tubes 56-1 and 56-3 are joined to junction section 42 on opposite sides thereof at flanges 59-1 and 59-3. Canted brace tubes 64-1 and 64-3 are also capable of horizontal floatation due to the size and location of tanks 88-1 and 88-3. Tubes 64-1 and 64-3 are then respectively joined at flanges 72-1, 74-1 and 72-3, 74-3 on opposite sides of the spinal tube with the entire assembly continuing to float in horizontal manner. A cable is now attached to ring 81-1 and expanded through ring 83-4 and connected to ring 81-3. A similar cable is also connected to ring 81-1 and extended through ring 83-2 and connected to ring 81-3. This permits the inner tube sections 54-2 and 54-4 on which rings 83-2 and 83-4 are located to serve as gin poles during the next step in the assembly.

Tanks 88-1 and 86-1 are then flooded so that elements 56-1 and 64-1 sink to a vertical orientation so as to rotate the device about the spinal tube 34 axis to cause the radial tube 56-3 to extend upwardly perpendicularly with respect to and above the surface of the water. The radial tube 56-2 can then be easily floated into position for connection to flange 59-2 following which is connected to the flange 74-2 and flange 72-2.

The process is then repeated on the opposite side with radial tube 56-4 being connected to flange 59-4 and canted brace tube 64-4 also being similarly connected to its associated flanges 74-3 and 72-4.

Tanks 88-1 and 86-1 are then filled with air and tanks 80 and 82 are flooded with sufficient water to cause the entrapment shell 20 to sink to its lower position to position the four horizontal radial tubes 56-1 etc. to float on the surface. The flexible hose conduits and other bracings can then be attached to complete the assembly.

An anchor cable 120 is connected to the device with an anchor 115 being attached to the upper end of cable 120 upstream of wellhead 14 as shown in FIG. 7. Cable 120 is of a predetermined length and anchor 115 is positioned so that the vehicle 10 will swing about anchor 115 under the action of the current so as to pass over wellhead 14.

A towing vessel 13 such as a tug is connected to the vehicle by a line 112 with a buoy 121 also being connected to the anchor 115 by a line 117. The towing vessel 13 permits the vehicle 10 to swing into position along with buoy 121 to which hose members 62 from the vehicle are connected. Airlines (not shown) extend from the tug 13 to the vehicle for permitting the filling with air or flooding of the floatation tanks under control from the tug permitting the device to be moved vertically.

Tug 13 slowly maneuvers to permit the vehicle 10 to swing about anchor 115 to a position over the wellhead. The vehicle is caused to settle downwardly over the wellhead by flooding the tanks and is tied down and operated in the manner discussed hereinafter in conjunction with the first method of positioning illustrated in FIGS. 2 and 3.

FIG. 6 illustrates the internal details of the flange junctions 59-1 and an associated ring 83-1, similar rings 83-2, 83-3 and 83-4 are provided on the other flange junctions 59-2, 59-3 and 59-4.

A second manner of positioning of the preferred embodiment will now be discussed with reference being made to FIGS. 1 through 3. Vehicle 10 will initially be positioned in the righthand position of FIG. 1 downstream of well 14 with respect to the direction of current flow 11 and held in position by the towing vessel 13 which is connected to the vehicle by towline 12. Valve 48 will be open. The towing vessel 13 will slowly move the vehicle 10 in the direction of dashed arrows 140 up over the wellhead 14 at which time the air controls on the towing vessel 13 will be operated to release air from the various air lines 90, 92 etc. to permit water to flow into the floatation tanks to decrease the overall buoyancy of the device and cause it to move downwardly in the direction of arrow 142 to position the vehicle as shown in the lefthand portion of FIG. 1.

As the vehicle moves over the wellhead 14, it moves into the position shown in FIG. 2 so that the effluent entrapment shell 20 comes down over and completely encloses the wellhead with the effluent from the wellhead then being directed upwardly through the main spinal tube 34 and out through the open valve 48. Divers 150 will position guy lines 152 between the vehicle and the bottom of the body of water as shown in FIG. 2 to stabilize the vehicle and will then connect hose members 62 to the outer ends of horizontal tube sections 58-1 etc. in the manner illustrated in FIG. 4 and will then open valve means 60. Valve 48 will then be closed to cut off the discharge of effluent therefrom and cause the effluent to flow upwardly through the hose members 42 to separation tank means 16 where gas is vented through vent 17 as shown in FIG. 3. From there, the separated effluent is taken to a storage tank 18 and then to a tender or possibly to a land installation as required by the particular installation.

It should be understood that numerous modifications of the preferred embodiment will undoubtedly occur to those of skill in the art. For example, it is possible that the tube members 66-1, 69-1, 70-1, 76-1, 81-1 etc. could be replaced by a solid brace member and that more sophisticated controls could be provided with the floatation tank; for example, remotely controlled valves could be provided in place of the exhaust nipples 92, 102 etc. associated with the various floatation tanks. Therefore, the spirit and scope of the invention should be limited solely by the appended claims.

I claim:

1. A marine blowout recovery system for recovering the effluent from an underwater well blowout including:

a towable submergible vehicle comprising: an effluent entrapment shell having a hollow interior chamber positionable over a well blowout and having a downwardly facing bottom opening for permitting the flow of effluent into said hollow interior chamber; tubular outflow means communicating on one end with an upper portion of said hollow interior chamber for receiving effluent therefrom; and hollow floatation tank means mounted on said tubular outflow means connected to a controlled source of pressurized air for providing a desired amount of buoyancy to effect raising or lowering of the entire submergible vehicle when positioned beneath the surface of a marine environment;

flexible hose means connected on one end to said tubular outflow means for receiving effluent therefrom and connected on an opposite end to separation and storage means into which said effluent is discharged.

2. The invention of claim 1 wherein said tubular outflow means includes:

a vertically extending rigid main spinal tube having one end communicating with the interior chamber of said effluent entrapment shell; and a plurality of horizontal radial tubes extending outwardly of said spinal tube at a location spaced substantially above said effluent entrapment shell.

3. The invention of claim 1 wherein said tubular outflow means includes:

a vertically extending main spinal tube having one end communicating with the interior chamber of said effluent entrapment shell;

a plurality of horizontal radial tubes extending outwardly of said spinal tube at a location spaced substantially above said effluent entrapment shell; and a plurality of canted brace tube members each respectively extending between said main spinal tube at a lower location adjacent said shell and one of said horizontal radial tubes.

4. The invention of claim 1 wherein said tubular outflow means includes:

a vertically extending main spinal tube having one end communicating with the interior chamber of said effluent entrapment shell;

a plurality of horizontal radial tubes extending outwardly of said spinal tube at a location spaced substantially above said effluent entrapment shell; and a plurality of canted brace members each respectively extending between said main spinal tube at a lower location adjacent said shell and one of said horizontal radial tubes;

and wherein said hollow floatation tank means comprise cylindrical tanks individually coaxially positioned on and over said horizontal radial tubes, said main spinal tube and said canted brace tube members.

5. The invention of claim 1 wherein said tubular outflow means includes:

a vertically extending main spinal tube having a lower end communicating with the interior chamber of said effluent entrapment shell and valve means on its upper end; and a plurality of horizontal radial tubes extending outwardly of said spinal tube at a location spaced substantially above said effluent entrapment shell but below said valve means.

6. The invention of claim 1 wherein said tubular outflow means includes:

a vertically extending main spinal tube having its lower end communicating with the interior chamber of said effluent entrapment shell and valve means mounted adjacent its upper end;

a plurality of horizontal radial tubes extending outwardly of said spinal tube at a location spaced substantially above said effluent entrapment shell but below said valve means; and a plurality of canted brace tube members each respectively extending between said main spinal tube at a lower location adjacent said shell and one of said horizontal radial tubes.

7. The invention of claim 1 wherein said tubular outflow means includes:

a vertically extending main spinal tube having a lower end communicating with the interior chamber of said effluent entrapment shell and valve means in a portion adjacent its upper end;

a plurality of horizontal radial tubes extending outwardly of said spinal tube at a location spaced substantially above said effluent entrapment shell but below said valve means; and a plurality of canted brace tube members each respectively extending between said main spinal tube at a lower location adjacent said shell and one of said horizontal radial tubes;

and wherein said hollow floatation tank means comprise individual cylindrical tanks individually coaxially positioned on and over said horizontal radial tubes, said main spinal tube and said canted brace tube members.

8. The invention of claim 1 wherein said tubular outflow means includes:

a vertically extending rigid main spinal tube having one end communicating with the interior chamber of said effluent entrapment shell;

a plurality of horizontal radial tubes extending outwardly of said main spinal tube at a juncture location spaced substantially above said effluent entrapment shell; and individual valve means provided in the outer ends of said horizontal radial tubes.

9. The invention of claim 8 additionally including valve means in said main spinal tube adjacent the upper end thereof and above the juncture of said horizontal radial tubes therewith.

10. The invention of claim 9 additionally including a plurality of canted brace tube members each having upper and lower ends and each respectively connected at their lower end to the main spinal tube at a location adjacent said entrapment shell and connected at their upper ends to one of said horizontal radial tubes immediately inwardly of the valve means in said horizontal radial tube.

11. The invention of claim 10 wherein floatation tank means comprises cylindrical tanks individuall coaxially positioned on and over said main spinal tube and said horizontal radial tubes.

* * * * *